United States Patent [19]

Seidenberg

[11] 3,956,850

[45] May 18, 1976

[54] KISSING DOLL HAVING SQUEEZABLE ARM AND SOUNDER LOCATED SUBSTANTIALLY MIDWAY BETWEEN ARM AND MOUTH

[75] Inventor: Robert J. Seidenberg, Oceanside, N.Y.

[73] Assignee: Eugene Doll & Novelty Co., Inc., New York, N.Y.

[22] Filed: Jan. 31, 1975

[21] Appl. No.: 546,024

[52] U.S. Cl. ..... 46/117; 46/163

[51] Int. Cl.[2] ..... A63H 5/00

[58] Field of Search ..... 46/117, 118, 44, 116, 46/143

[56] References Cited

UNITED STATES PATENTS

| | | | |
|---|---|---|---|
| 1,630,240 | 5/1927 | Bolton | 46/117 |
| 3,534,495 | 10/1970 | Goldman | 46/117 |
| 3,603,029 | 9/1971 | Nutting | 46/117 |

*Primary Examiner*—F. Barry Shay
*Attorney, Agent, or Firm*—J. B. Felshin

[57] ABSTRACT

This doll has means to simulate the sound and feel of a kiss. One arm and hand of the doll, made of elastic or resilient plastic material, constitutes a bulb connected by a tube sealed to an opening at the mouth and between the lips of the doll. In the tube is a reed through which air passes in a direction toward the opening, without sounding the reed, when the arm is squeezed. The lips of the doll can then be pressed against a persons cheek, and pressure thereafter released from the arm to allow the bulb to expand, to create a partial vacuum causing the cheek to be drawn and held to the lips in the manner of a vacuum cup. Upon thereafter pulling the doll's head away from the cheek, a suction feeling is created, simulating the feel of a kiss, and air rushes through the opening and back through the tube to said arm, to sound the reed, thus simulating the sound of a kiss. The reed is placed at a point remote from the arm, so that a slight squeeze of the arm or squeezing the hand of said arm, alone, will not expel sufficient air through the reed to create a back flow of air through the reed sufficient to sound the reed, when the doll's head is pulled away from the cheek. Reducing sleeves are fixed into the tube to prolong the whistling sound.

7 Claims, 6 Drawing Figures

KISSING DOLL HAVING SQUEEZABLE ARM AND SOUNDER LOCATED SUBSTANTIALLY MIDWAY BETWEEN ARM AND MOUTH

This invention relates to kissing dolls, that is to dolls which have means to create the feel of a kiss against a person's cheek and the whistling sound of a kiss.

An object of this invention is to provide a doll of the character described having a doll's head formed with an opening at the mouth and between the lips. The lips are in puckering position. The doll has an arm of elastic plastic or rubber like material in the form of a squeezable bulb connected by a tube to said opening. In the tube is a whistling reed which sounds only when air rushes through the tube back to the arm bulb. When the arm is squeezed air is expelled through the tube without sounding the reed. While the arm is held squeezed, the lips are pressed against the cheek of a person. Then pressure on the arm is released, to cause a partial vacuum in the tube and arm to hold the lips to the cheek in the manner of a suction cup. When the doll's head is thereafter pulled off the cheek, a sucking feel, like a kiss is created on the cheek, and at the same time, air rushes back through the reed to cause a whistling sound, simulating the sound of a kiss.

Another object of this invention is to place the reed in the tube at a substantial distance remote from the arm, to leave air in the tube between the reed and the arm, so that less air rushes back through the reed when the cheek is separated from the lips. With such construction, it takes a greater squeeze to cause a kissing sound, and a slight squeeze of the arm, or a squeeze of the hand only, of the arm, will not cause sufficient vacuum, when the doll is pulled away from the cheek, to cause a sound. It will require a substantial squeeze of the arm to create the kissing sound.

Yet another object of this invention is to provide in a doll of the character described, reducing sleeves in the tube at the lips and at the arm of the doll, to prolong the whistling sound which simulates the sound of a kiss.

A further object of this invention is to provide a doll of the character described, having one tube portion fixed in the opening at the lips of the doll, another tube portion fixed to the arm bulb, and a whistling or sounding reed assembly, inserted partially in said one tube portion and partially in another tube portion and fixed to both tube portions, to facilitate assembly of the doll.

Yet a further object of this invention is to provide a strong and durable doll of the character described, which will be relatively inexpensive to manufacture, easy to assemble, attractive in appearance, easy to manipulate, and which shall yet be practical and efficient to a high degree in use.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

Figure 1:
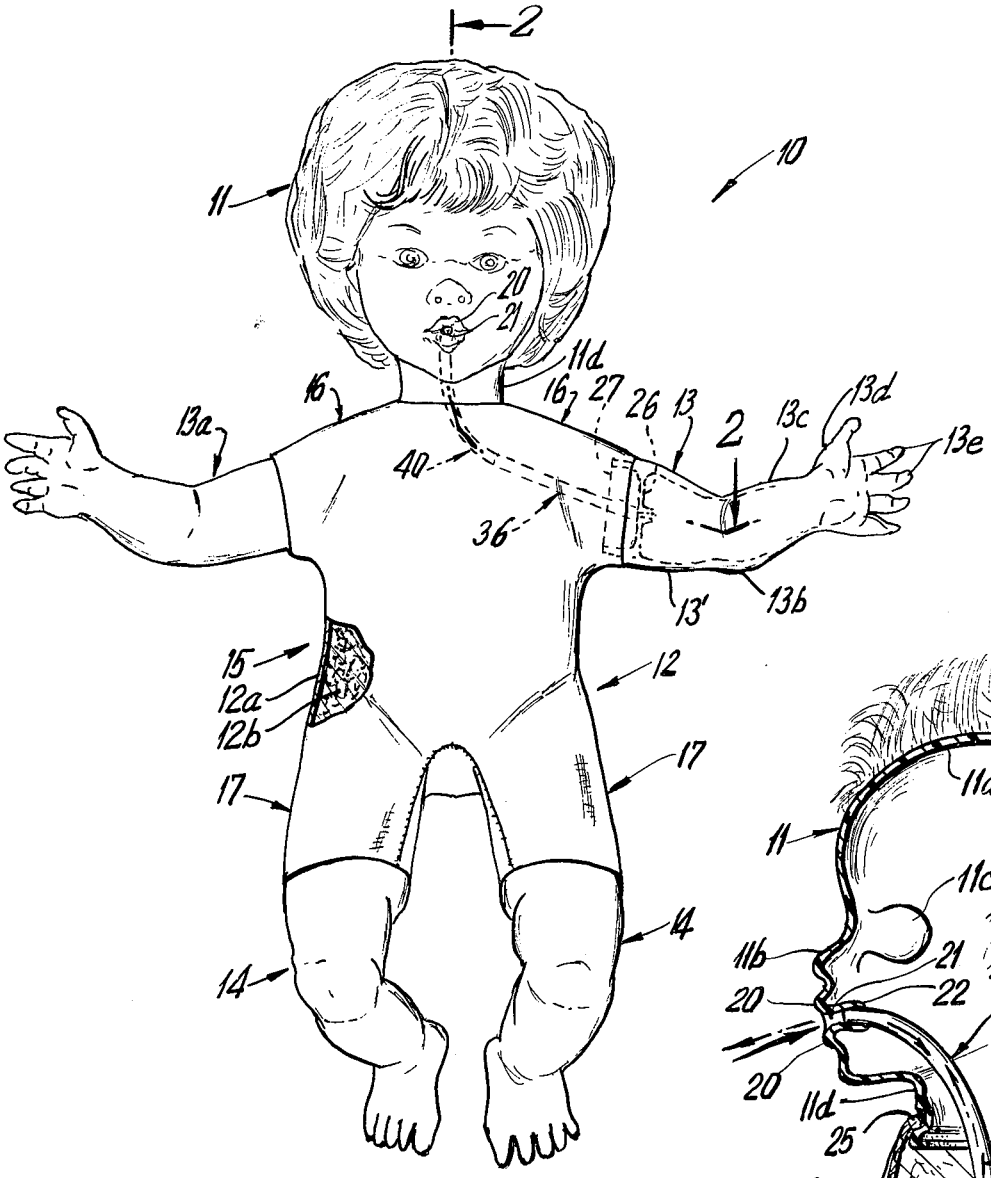
FIG. 1 is a front elevational view of a doll embodying the invention.
Figure 2:
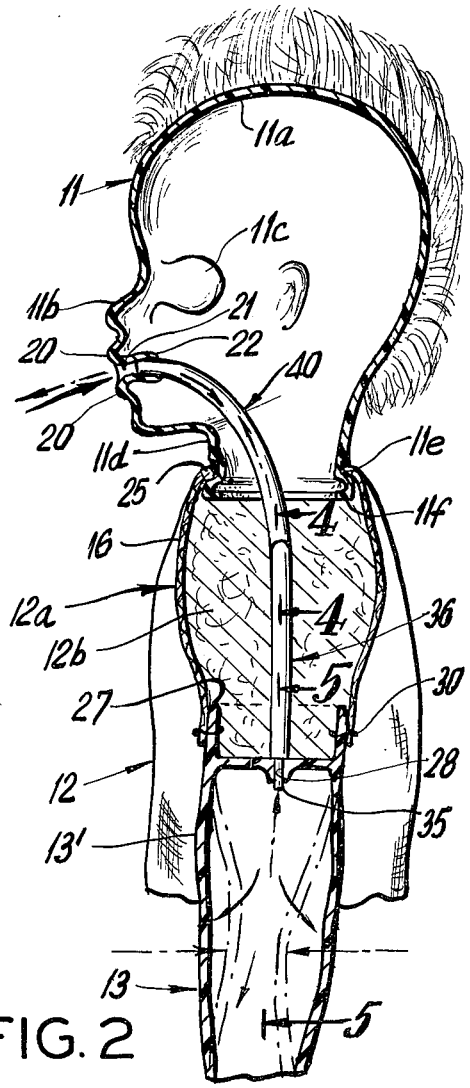
FIG. 2 is a cross-sectional view taken on line 2—2 of FIG. 1.
Figure 3:
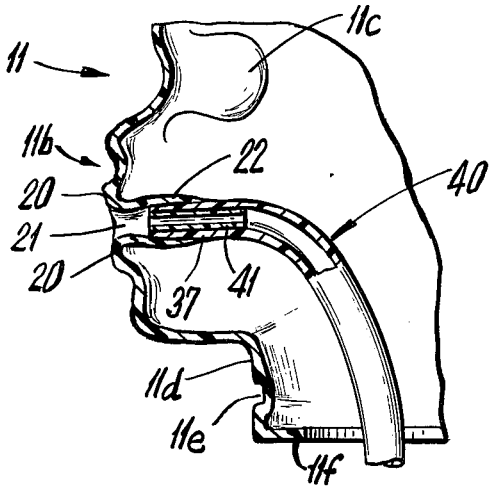
FIG. 3 is a partial, enlarged cross-sectional view of the head of the doll.
Figure 4:
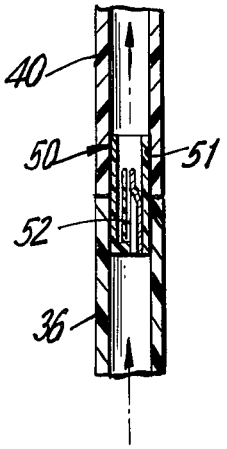
FIG. 4 is a cross-sectional view taken on line 4—4 of FIG. 2, illustrating by arrows the expelling flow of air without sounding the reed.
Figure 4A:
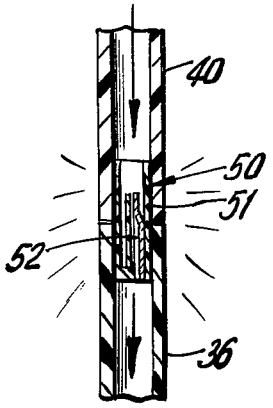
Figure 5:
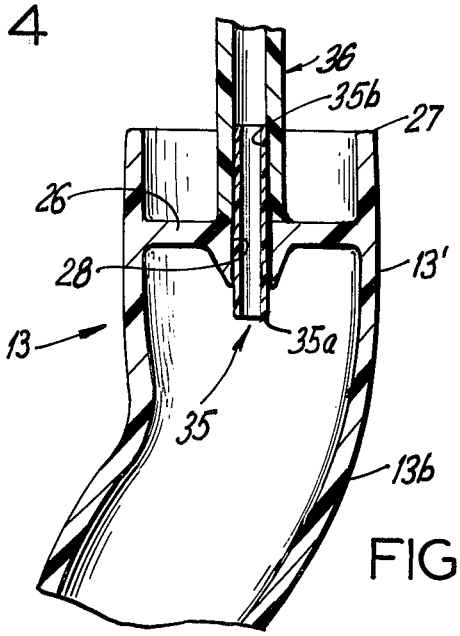

FIG. 4*a* is a view similar to FIG. 4 but showing by arrows the direction of flow of air back into the arm, to sound the reed; and FIG. 5 is a cross-sectional view taken on line 5—5 of FIG. 2.

Referring now in detail to the drawing, 10 designates a doll embodying the invention. Said doll 10 comprises a head 11 made of vinyl or any other suitable material such as elastic plastic or rubber like material, a body 12, arms 13 and 13a made of vinyl or other plastic, elastic material, and legs 14 of similar material. The arms 13, 13*a* and legs 14 are hollow and may be molded.

The body 12 comprises a torso portion 15, shoulder portions 16 and thigh portions 17. Said body 12 is stuffed, comprising an outer cloth textile skin simulating cover portion 12*a* filled with stuffing 12b.

The head 11 is hollow and comprises head portion 11*a*, a face portion 11*b*, eye sockets 11*c* to receive doll's eyes, and a neck portion 11*d*. The neck portion is open at the bottom, and has an annular external groove 11*e* just above a lower inwardly extending flange 11*f* of the neck portion. The face portion 11*b* of the head comprises upper and lower lips 20 in puckered position with a round or cylindrical opening 21 therebetween, formed by a tubular portion 22 extending horizontally inwardly. The lips 20 substantially form a circle surrounding the opening 21 and projecting forwardly, and lying in almost one plane.

The textile cover 12*a* has an upper neck opening edge portion 25 projecting into the annular groove 11e and is attached to the neck portion of the doll head, within said groove in any suitable manner.

Arm 13 of the doll differs from arm 13*a* in the manner hereinafter described. Said arm 13 is hollow. It has an upper arm portion 13', an elbow portion 13*b*, a forearm portion 13*c* and a hand portion 13*d* provided with fingers 13*e*. The fingers 13e are solid, but the portions 13', 13*b*, 13*c* and 13*d* are hollow. Said arm 13 has a transverse integral wall portion 26 located below the upper edge 27 of said arm. The transverse wall portion has a central opening 28 for the purpose hereinafter appearing. The arm 13 thus constitutes a squeezable bulb which when squeezed and then released will expand to normal condition.

The left shoulder portion of the cover 12*a* fits over the upper part of portion 13', of arm 13, and may be stitched thereto as at 30, or attached thereto in any other suitable manner. Inserted into opening 28 and glued to the inner surface of said opening, is a short rigid plastic reducing sleeve 35 having a portion 35*a* projecting down below the transverse wall 26, and a portion 35*b* projecting up above said transverse wall.

Fitted onto the upwardly projecting portion 35*b* of sleeve 35 and glued thereto, is the lower end of a flexible tube 36 which extends up into the adjacent shoulder 16 of the torso 15, for the purpose hereinafter explained.

Inserted into the tube 22 and glued thereto is one end 37 of a flexible tube 40 similar to tube 36 and extending down through the neck 11d and into the left shoudler 16 of the torso 15. A reducing short rigid sleeve 41 is received in and glued to the end portion 37 of tube 40. The tubes 36 and 40 are of substantially equal lengths. They are joined together in end to end or tandem relation within the left shoulder portion 16 of the torso, by a whistling or sounding reed 50. The reed 50 is of usual construction and comprises a tube 51 within which is fixed a usual reed 52 projecting in such direction that air passing upwardly in the direction of the arrows in FIG. 4 will not sound the reed, but air passing downwardly in the direction of the arrows in FIG. 4*a*, will sound the reed. The tube 51 is glued to the adjacent ends of tubes 36, 40. The adjacent ends of said tubes 36, 40 meet at about the middle of tube 51.

Arm 13*a* may be similar to arm 13 except that it need not have the transverse wall 26.

The legs 14 are hollow and fit into the lower ends of the legs of the cover 12*a* and are attached thereto by stitching or in any other suitable manner.

When arm 13 is squeezed or compressed, air will be caused to flow up through sleeve 35, tubular portion 36, reed 50, tubular portion 40, tube 41 and expelled through lip opening 21. If while the arm 13 is held squeezed, the lips 20 of the doll pressed against the cheek of a person, and the arm then released, a partial vacuum is created in the tubes 40, 36 and arm 13 to create a suction on the cheek to hold the cheek to the lips. During this action no sound is made by the reed. However if the doll is thereafter pulled away from the cheek, the sudden inrush of air gives the cheek a feeling of a kiss, and at the same time air flowing back through the reed causes the reed to sound or whistle, simulating the sound of a kiss.

The reed is spaced remotely from the arm 13, so that the air remaining in tube 36 after squeezing the arm will not flow back through the reed, thus reducing the sound. With such construction, if the hand of the arm 13, only, is squeezed, there may not be sufficient flow of air and hence suction, created, to cause the kissing sound. This arrangement prevents accidental sounds or too noisy a doll.

Also the use of the reducing sleeves 35, 41 slows the flow of air during suction, to prolong the period of sound made by the reed.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim:

1. A doll comprising a doll head, a torso and an arm, said head having a neck and lips and being formed with an opening between the lips and open to the outside of said head, and said torso having a shoulder, said arm having an upper arm portion, an elbow portion, a forearm portion and a hand portion, said portions being attached to said shoulder and being hollow and constituting a collapsible bulb which may be squeezed and which will expand to normal condition when released, a tube communicating with said bulb, passing through said shoulder, torso and neck into said head, and connecting said bulb with said opening between said lips, and a sounding reed in said tube in position to be sounded only when air flows through said opening into said tube toward said bulb, said bulb, when squeezed, causing air to be flowed out of said bulb and through said tube and opening to the outside air, and said bulb, when allowed to expand, causing air to flow through said opening and tube into said bulb, and simultaneously sound said reed, said reed being located remotely from said bulb substantially midway along said tube, said bulb being wholly closed except for its communication with said tube.

2. The combination of claim 1, and a reducing sleeve in said tube.

3. The combination of claim 2, said reducing sleeve being located at said opening.

4. The combination of claim 3, and a second reducing sleeve in the end of said tube located at said bulb.

5. The combination of claim 2, said reducing sleeve being located in the end of said tube at said bulb.

6. The combination of claim 1, said tube comprising a first tube portion attached to said bulb, a second tube portion attached to said opening, and said reed projecting partially into said first tube portion and partially into said second tube portion and attached to both.

7. The combination of claim 2, said tube comprising a first tube portion attached to said bulb, a second tube portion attached to said opening, and said reed projecting partially into said first tube portion and partially into said second tube portion and attached to both.

* * * * *